United States Patent [19]

Calamur

[11] 4,251,627

[45] Feb. 17, 1981

[54] JET MIXING IN PREPARATION OF MONODISPERSE SILVER HALIDE EMULSIONS

[75] Inventor: Narasimhan Calamur, Aurora, Ill.

[73] Assignee: E. I. Du Pont de Nemours and Company, Wilmington, Del.

[21] Appl. No.: 910,850

[22] Filed: May 30, 1978

[51] Int. Cl.[3] ..... G03C 1/02

[52] U.S. Cl. ..... 430/569

[58] Field of Search ..... 96/94, 94, BF, 114.7; 366/339; 430/569

[56] References Cited

U.S. PATENT DOCUMENTS

| | | | |
|---|---|---|---|
| 3,628,959 | 12/1971 | Thielemann | 96/94 R |
| 3,650,757 | 3/1972 | Irie et al. | 96/94 R |
| 3,790,386 | 2/1974 | Posse et al. | 96/94 R |
| 3,821,002 | 6/1974 | Culhane et al. | 96/94 R |
| 3,897,935 | 0/1975 | Forster | 366/339 |
| 4,147,551 | 4/1979 | Finnicum et al. | 96/94 R |

OTHER PUBLICATIONS

Hautot, A. Photographic Theory 1962, pp. 17, 26, 27. Liege Summer School, 1962. The Focal Press. London and N. Y.

James, R. W. Photographic Emulsions-Recent Developments, 1973 pp. 131, 132; 1973; Noyes Data Corp. Ridgeway, N. J.

*Primary Examiner*—Edward C. Kimlin

[57] ABSTRACT

A process for preparing a photographic emulsion having a controlled grain size, structure, and size distribution, wherein a silver salt and an alkali metal halide react to precipitate silver halide grains at uniform pAg using high velocity mixing jets directed vertically downward to accomplish rapid dilution of and mixing of reactants in a conventional paddle-agitated precipitation vessel. A single recycle loop, or double recycle loops, feeds the mixing jets.

7 Claims, 6 Drawing Figures

JET MIXING IN PREPARATION OF MONODISPERSE SILVER HALIDE EMULSIONS

CROSS-REFERENCE TO RELATED APPLICATION

This application is related, in subject matter, to Serial No. 554,226, Finnicum et al, filed Feb. 28, 1975, now U.S. Pat. No. 4,147,551.

DESCRIPTION

1. Technical Field

This invention relates to processes for the preparation of photographic emulsions and more particularly to processes in which precipitation of the silver halide grains is carried out in a carefully controlled constant pAg environment.

2. Background Art

It is recognized that the preparation of silver halide emulsions should be carried out under carefully controlled conditions. For example, the accurate control of rates of addition of reactants, pAg, pH, and the duration of the precipitation as well as temperature and the relative mixing uniformity of reactants added from two separate sources is desirable. It is equally recognized that in the preparation of monodisperse (narrow grain size distribution) silver halide emulsions by double jet precipitation, rapid dilution and mixing of reactants in the precipitation vessel play an important role in determining the final mean grain volume (MGV) and grain size distribution (GSD). Prior art processes usually employ a high speed agitator, and in some cases a dispersator such as disclosed in Frame and Johnson, U.S. Pat. No. 3,415,650, to effect rapid dispersion of reactants and to maintain uniform halide or silver ion concentration in the precipitation vessel.

Such rapid mixing has not been possible in vessels usually employed to make conventional, polydisperse silver halide emulsions where grain growth takes place by Ostwald ripening and where control of pAg or pBr is of no consequence. Typically, a paddle agitated, unbaffled vessel is employed where the primary purpose of agitation is to prevent the grains from settling and to maintain uniform ripening temperature in the vessel. One object of this invention is to provide a process which can make use of such a conventional vessel to prepare monodisperse silver halide emulsions.

BRIEF DESCRIPTION OF THE DRAWINGS

In the accompanying drawings, forming a material part of this disclosure.

DISCLOSURE OF INVENTION

Figure 1:
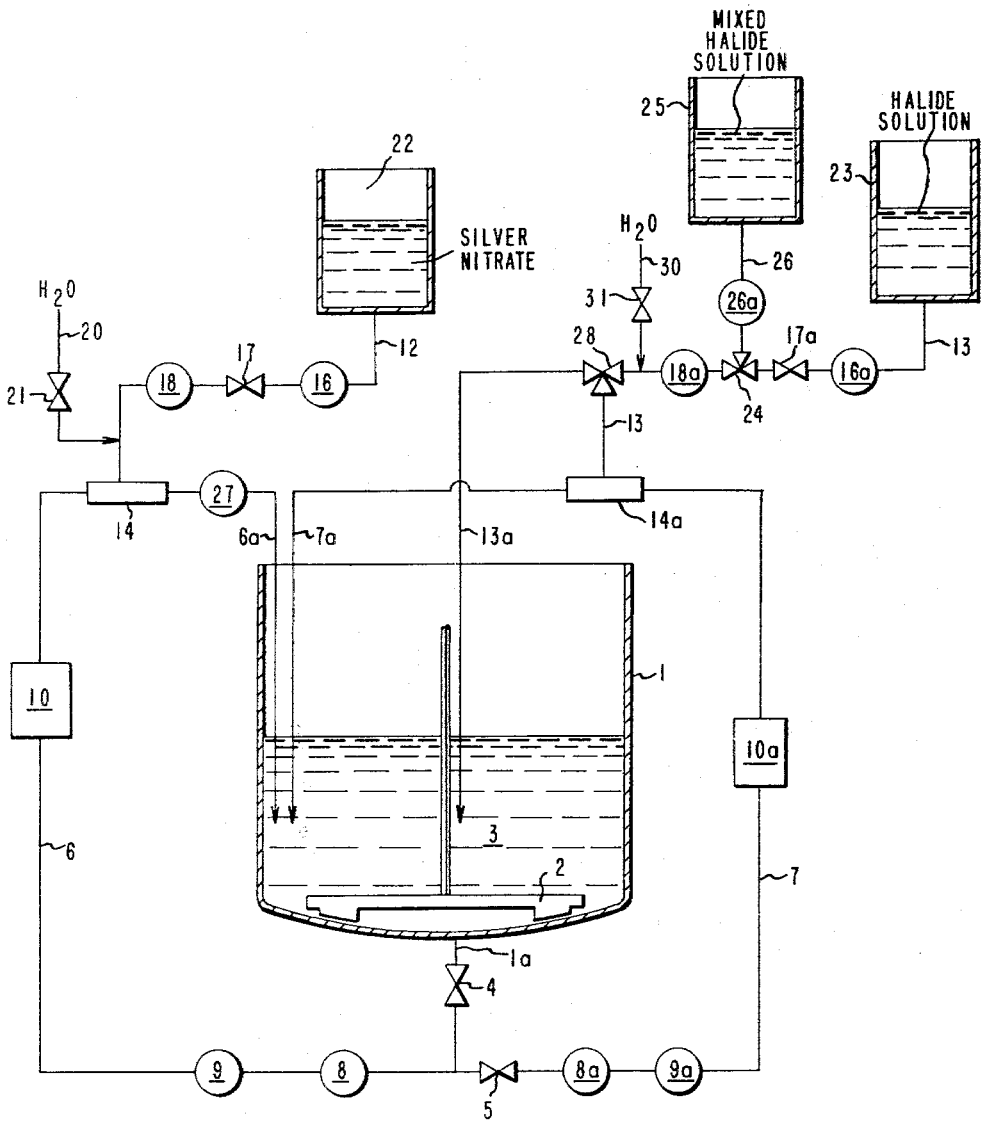
FIG. 1 is the diagram of an apparatus, partially in cross-section, for carrying out the process of the invention.

This invention provides an improved process for preparing a photographic emulsion having a controlled silver halide grain size, structure, and size distribution, which includes the steps of:

1. adding silver nitrate to a stream supplied from a precipitation vessel containing gelatin solution, and recycling this stream back to the vessel,
2. adding a single halide or mixed halide solution to another stream supplied from the vessel, and recycling this stream back to the vessel or adding the halide solution or solutions directly to the vessel, to precipitate silver halide grains therein, and
3. recycling the contents of the vessel into the stream or streams whereby additional silver halide grains are precipitated on the initially precipitated grains to form silver halide grains of controlled structure, size and size distribution, and an important feature of the process being that said recycle streams are injected into the precipitation vessel in downwardly directed jets at a velocity of 8–30 ft./sec. (2.44–9.14 m/sec.) so as to effect uniform, high velocity, jet mixing in a defined region and maintain pAg constant.

The process of the invention, which is adaptable to both single and double recycle type processes, provides advantages over either the conventional double jet or recycle stream processes in that it provides for adequate dilution of the reactants and uniformity of mixing, generally confines the chemical reaction to a specific region of the precipitation vessel, and shortens precipitation times. The high velocity jets emerge downwards and expand in a conical envelope of about 20° with a high degree of turbulent mixing regardless of vessel size or shape.

As illustrated in the drawings, precipitation vessel 1 is jacketed so as to permit the circulation of heating and cooling water in direct contact with the vessel wall, and is provided with an agitator or paddle 2, and an initial charge of gelatin solution 3. Storage vessels 22 and 23 are provided for storing and supplying aqueous silver nitrate solution and aqueous alkali metal halide solution, respectively, to vessel 1. A mixed halide solution storage and supply vessel 25 is also provided.

A discharge line 1*a* equipped with control valve 4 is provided in order to recirculate the contents of vessel 1 through either recycle line 6 or recycle line 7, or both; these are each referred to at various times hereafter as a "recycle path" or "loop".

Referring first to recycle line 6, the latter is provided with a rotameter 8 for measurement of flow rates, a recycle pump 9, a heat exchanger 10, a mixer 14, and an ion monitor 27 to monitor the silver ion concentration in recycle line 6, and it terminates in a vertical downpipe 6*a* which extends below the liquid level in vessel 1.

Mixer 14 in line 6 is also connected to conduit 12, which serves to add silver nitrate solution from vessel 22. Conduit 12 is equipped with metering pump 16 for controlling the flow rate of silver nitrate solution, and with valve 17 and rotameter 18 for adjusting and measuring the flow rate.

At some point in the line, between rotameter 18 and mixer 14, conduit 12 connects with a water line 20, the volume of which is adjusted by valve 21 in line 20, so that downpipe 6*a* serves to return to vessel 1 the mixture formed by combining the recycle in line 6 with the silver nitrate from vessel 22 and the water from line 20.

The right hand side of FIG. 1 illustrates an alternate recycle conduit 7 which is connected to the discharge conduit 1*a* and is provided with control valve 5, rotameter 8*a*, recycle pump 9*a*, heat exchanger 10*a*, and mixer 14*a*, and it, too, terminates in a vertical downpipe 7*a* which extends below the liquid level in vessel 1. Heat exchangers 10 and 10*a* serve to control the temperature of the recycle by means of circulation of hot or cold water. Mixer 14*a* is connected through conduit 13 to vessel 23 for direct addition of aqueous alkali metal halide solution to recycle line 7. Conduit 13 is equipped with a metering pump 16*a* and a two-way valve 17*a* for controlling the flow rate of alkali metal halide solution from vessel 23, and with a three-way valve 24 which permits mixed halide solution in vessel 25 to drain through discharge conduit 26 and metering pump 26*a* into conduit 13. Conduit 13 is also provided with rotameter 18*a* for measuring flow rates therein, and with three-way valve 28 for selective addition of aqueous alkali metal halide or mixed halide solution to mixer 14*a* in recycle line 7, or directly to vessel 1. Conduit 13 terminates in a vertical downpipe 13*a* which extends below the liquid level in vessel 1. Provision is also made for the addition of water to conduit 13 at a point between rotameter 18*a* and valve 28, the water being admitted through line 30 and control valve 31.

In addition to the valves illustrated in FIG. 1, another valve (not shown) may be provided in conduit 1*a* from vessel 1 for recycling the contents back to vessel 1, or to another vessel, and a valve (not shown) may be provided in conduit 12 to provide for the direct addition of silver salts to the vessel 1. Also, in addition to ion monitor 27 additional ion monitors (not shown) may be provided for monitoring the silver ion concentration at other locations in the process. The rotameters and ion monitors may be used to generate control signals for controlling flow rates in the process and controlling pAg or excess halide concentrations at various points in the process.

The mixers 14 and 14*a* are preferably tee-mixers, although other types of static or dynamic mixers may be used. Using a conventional side tee-mixer, the main stream of the mixer is used for the recycle path of the process and the side stream of the mixer is used as the addition path for aqueous silver and halide solutions. The side tee-mixer provides highly efficient mixing and precipitation in a reasonably short length of the recycle path, e.g., substantially 100% mixing is accomplished within 3 to 7 stream diameters of the silver solution tee addition when the mass velocity ratio of the main path to the side path is 2.7. The optimum mass velocity ratio of 2.7 must be maintained for efficient mixing of the components in a tee-mixer. However, mixing times may be controlled by varying the recycle flow rate and proportionally changing the side path flow rate.

The recycle ratio for the process is defined as the ratio of the recycle flow rate to the silver or halide solution flow rate. Although any recycle ratio may be used, it is preferred to maintain the recycle ratio equal to or greater than 10.

Figure 2:
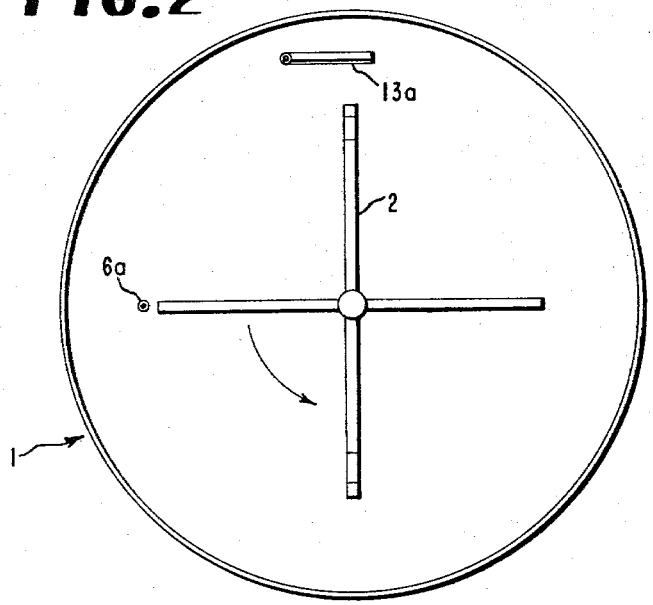
FIG. 2 is a top view of FIG. 3, which in turn is a cross-section of precipitation vessel 1 in FIG. 1 as adapted to the single recycle loop arrangement.
Figure 3:
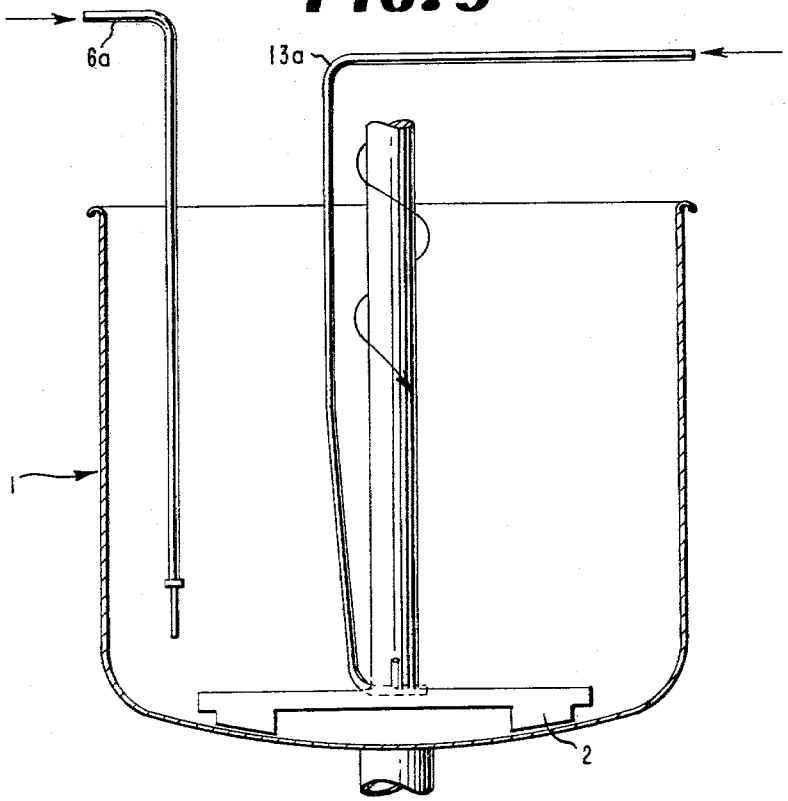

In operating the process of the invention, an aqueous solution of gelatin 3 is recycled from the bottom of the vessel 1 through a single or double loop. Where a single recycle loop is used, aqueous silver nitrate can be injected into the recycle line 6 via a tee-mixer at 14 and halide solutions fed directly to the vessel 1, much as described in copending U.S. Pat. Application Ser. No. 554,226, filed Feb. 28, 1975, now U.S. Pat. No. 4,147,551, but in the process of the invention the recycle path reentering the vessel 1 emerges vertically downward and at substantially high velocities, usually in excess of 8 ft./sec. (2.44 m/sec.), preferably 20, and up to 30, through a nozzle or restricted orifice in vertical downpipe 6*a*. Vertical downpipe 13*a* also discharges in the same manner as 6*a* and at a velocity of about 1–12 ft./sec. (0.3–3.66 m/sec.) into vessel 1, but upstream or countercurrent from the direction of paddle rotation, and a quadrant away from vertical downpipe 6*a*, as illustrated in FIGS. 2 and 3. In a typical embodiment, downpipes 6*a* and 13*a* are 1" (2.54 cm) pipes with a jet orifice of about 0.19" (4.826 mm) ID.

Figure 6:
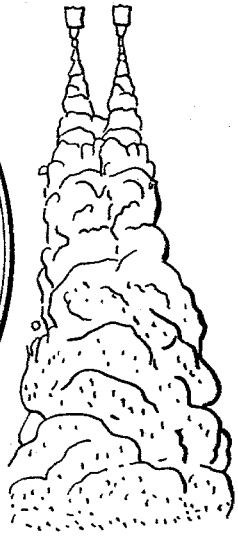
FIG. 6 illustrates diagrammatically two turbulent jets emerging from submerged nozzles Nos. 6*a* and 7*a* of FIGS. 4 and 5 into precipitation vessel 1.

These high velocity jets expand in a 20° angle conical envelope with a high degree of turbulent mixing as illustrated in FIG. 6, and regardless of the size or shape of precipitation vessel 1, they provide adequate dilution of the reactants and uniformity of mixing, and generally confine the chemical reaction to one quadrant of the vessel. After initial precipitation of silver halide grains, further precipitation occurs on top of existing stable grains continuously brought into the reaction zone by (a) the recycle path, (b) the path entrained by the expanding jets, and (c) the path swept by the swirling action of the paddle 2. This assures uniform pAg in the precipitation vessel 1.

Figure 4:
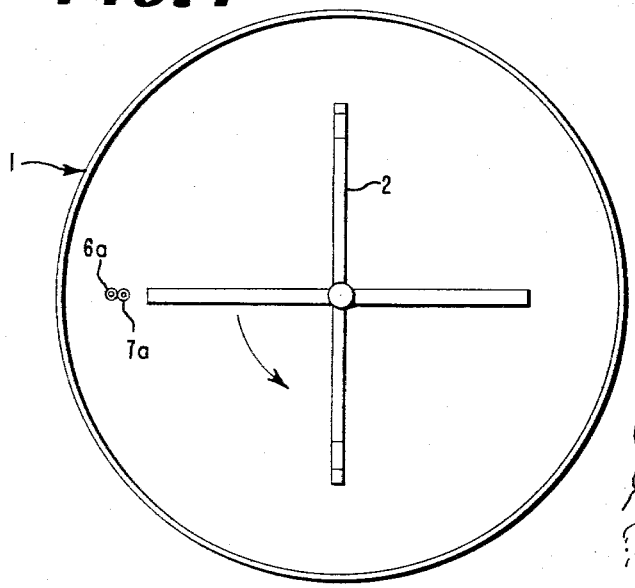
FIG. 4 is a top view of FIG. 5, which in turn is a cross-section of precipitation vessel 1 of FIG. 1 as adapted to the double recycle loop arrangement.
Figure 5:
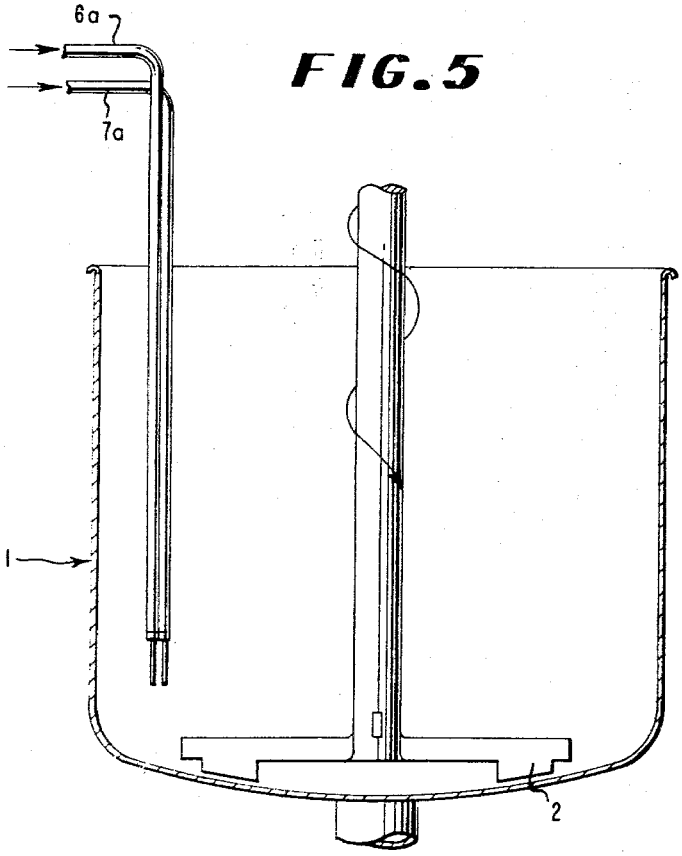

In the double recycle loop or path process, silver nitrate and alkali metal halide are injected into separate tee-mixers 14, 14*a* (one in each loop or stream). The two recycle loops or paths reenter vessel 1 in close proximity, as shown in FIGS. 1, 4 and 5, and emerge vertically downward at 6*a* and 7*a* with velocities in the range previously stated above. The jets expand in a 20° angle conical envelope (FIG. 6) to promote the high degree of turbulence and intense agitation needed to obtain nearly stoichiometric or equal strength volumetric mixing. They also confine the chemical reaction to volumes directly below and adjacent to the reentry points of the jets. Precipitation occurs on top of existing stable grains as described in the single recycle process.

The invention is illustrated in the Examples which follow, of which Examples 2 and 6 constitute the best mode.

EXAMPLE 1

A gelatin solution (A) comprising gelatin, ammonium hydroxide, ammonium nitrate, and distilled water, was prepared and digested in a conventional manner, and was placed in precipitation vessel 1, heated to 110° F. (43.3° C.) and agitated.

An aqueous solution of 3 molar silver nitrate (B) was prepared in a conventional manner, and placed in supply vessel 22, maintained at room temperature.

An aqueous solution of ammonium bromide (C), prepared from 2058 g, $NH_4Br$ and 6062 ml. $H_2O$ was placed in supply vessel 23, maintained at room temperature.

The digested gel solution (A) was fed into the recycle paths 6,7 at a flow rate of 1.6 gallons per minute (6.06 liters per minute) in each path. Silver nitrate solution (B) and ammonium bromide solution (C) were simultaneously added to respective recycle paths 6,7 at flow rates of 15 ml/min. through tee-mixers 14, 14*a*. A dispersion of initially precipitated silver bromide grains was formed in vessel 1 and continuously recycled at a recycle ratio of 253. Silver nitrate and ammonium bromide solution were continuously added to the recycle paths 6,7 for 15 minutes at a temperature of 110° F. (43.3° C.) and the pAg in precipitation vessel 1 was maintained at 8.5. The reentry velocity in vertical downpipes 6*a* and 7*a* was 8 ft./sec. (2.44 m/sec.). Continuous addition of silver nitrate and ammonium bromide solution to the respective recycle paths was continued for another 45 minutes while the pAg in vessel 1 was maintained at 9.0, the recycle flow rate in each path was increased to 2.5 gal./min. (9.46 liters/min.) and the reentry velocity of the jets was increased to 12.5 ft./sec. (3.81 m/sec.). The dispersion in vessel 1 was continuously recycled at a recycle ratio of 79.

At the completion of the above-described addition of silver nitrate and ammonium bromide solution, the dispersion of silver halide grains in vessel 1 was quenched by the addition of distilled water at approximately 72° F. (22.2° C.) and by circulating chill water at 55° F. (12.8° C.) in the jacket of vessel 1 till the temperature of the contents of the vessel was lowered to 84° F. (28.9° C.). The vessel contents were coagulated and washed in a conventional manner to produce emulsion curds.

Subsequently, the curds were redispersed, sensitized and coated on a photographic support as is well known in the art of manufacturing photographic films, to produce a film having high sensitivity and good image quality. The grain structure, determined by electron micrographs of the silver halide grains, was cubic.

The mean grain volume (MGV) and grain size distribution (GSD), determined by using histograms obtained from a Particle Size Analyzer which is discussed in "Photographic Science and Engineering", Vol. 17, Number 3, May/June 1973, pgs. 295–298, were 1.4 cubic microns and 1.0 to 1.9 cubic microns, respectively.

EXAMPLE 2

An aqueous gelatin solution (A) was prepared and digested in a conventional manner, and was placed in precipitation vessel 1, heated to 110° F. (43.3° C.), and agitated.

An aqueous solution of 3 molar silver nitrate (B) was prepared in a conventional manner, placed in supply vessel 22, and heated to a temperature of 110° F. (43.3° C.).

An aqueous solution of ammonium bromide (C), prepared from 3800 g. $NH_4Br$ and 11,200 ml. $H_2O$, was placed in supply vessel 23, and heated to a temperature of 110° F. (43.3° C.).

The digested gelatin solution was fed into the recycle paths 6,7 at a flow rate of 2 gallons per minute (7.57 liters per minute) in each path. Aqueous silver nitrate and ammonium bromide solutions were simultaneously added to these recycle paths as described in Example 1, through the side stream of tee-mixers 14, 14*a* for 80 seconds while the pAg was maintained at 8.5 in the precipitation vessel. The reentry velocity for each path was 24 ft./sec. (7.32 m/sec.) during the entire precipitation. An aqueous solution of ammonium hydroxide was then added to the precipitation vessel and precipitation continued at a pAg of 9.5. After 3 moles of the aqueous silver nitrate solution were added over 6.5 minutes, a mixed halide solution (KCl, KI, and $NH_4Br$) was introduced at the tee-mixer in place of the ammonium bromide solution and precipitation continued at the same rate for a further 10 minutes. The remaining silver nitrate and aqueous halide solutions were then added in 16 minutes, so as to form a dispersion of mixed crystal silver halide grains. These were immediately quenched, cooled, coagulated and washed, redispersed, sensitized, and coated in the manner described in Example 1.

The resulting film was a useful X-ray type film having high sensitivity and good image quality. The grain structure, determined by electron micrographs of the chloride-modified core-shell type silver iodobromide grains, showed the emulsion consisted of rounded cubic grains. The grain size distribution (GSD), determined by using histograms obtained from the Particle Size Analyzer (PSA), was between 0.6 and 1.8 cubic microns and the mean grain volume (MGV) was found to be 1.07 cubic microns.

EXAMPLE 3

A chloride-modified core-shell type silver iodobromide emulsion was prepared by the procedure described in Example 2, with the exception that the reentry jet velocity of the recycle paths was changed to 9 ft./sec. (2.74 m/sec.) while maintaining the same flow rate.

A similar emulsion resulted, having a GSD of between 0.45 and 1.8 cubic microns and a MGV of 0.95 cubic micron.

EXAMPLE 4

A chloride-modified core-shell type iodobromide emulsion was prepared using the procedure described in Example 2, with the following exceptions: (1) the halides were added directly to the vessel 1 and the silver nitrate was added to a single recycle path through a tee-mixer, (2) the recycle flow rate was maintained at 3.8 gallons per minute (14.38 liters per minute) and the recycle path jet reentry velocity was 18 ft./sec. (5.49 m/sec.), and (3) the halide path velocity ranged from 1–2 ft./sec. (0.3–0.61 m/sec.) at nucleation to 12 ft./sec. (3.66 m/sec.) at full growth.

The resulting film was a useful X-ray type film having high sensitivity and good image quality. Electron micrographs showed the emulsion consisted of rounded cubic grains, with a GSD of between 0.6 and 1.5 cubic microns, and a MGV of 0.93 cubic micron.

EXAMPLE 5

An aqueous gelatin solution (A) was prepared and digested in a conventional manner, and was placed in vessel 1, heated to 110° F. (43.3° C.), and agitated.

An aqueous solution of 3 molar silver nitrate (B) was prepared in a conventional manner, placed in the supply vessel 22, and heated to a temperature of 110° F. (43.3° C.)

An aqueous solution (C) of ammonium bromide, prepared from 95,000 g. $NH_4Br$ and 280,000 ml. $H_2O$, was placed in the supply vessel 23, and heated to a temperature of 110° F. (43.3° C.).

The digested gelatin solution was fed into the recycle path 6 at a flow rate of 50 gallons per minute (189.27 liters/minute). Aqueous silver nitrate solution was added to the recycle path as described in Example 1, through the side stream of a tee-mixer 14, and the aqueous ammonium bromide solution was added directly to vessel 1 for 80 seconds while the pAg was maintained at 8.5. The reentry velocity of the recycle path was 28 ft./sec. (8.53 m/sec.) during the entire precipitation, while the halide reentry velocity varied from 1.2 ft./sec. (0.37 m/sec.) at nucleation to 12 ft./sec. (3.67 m/sec.) at full growth. Aqueous ammonium hydroxide was then added to the conversion vessel and precipitation continued at a pAg of 9.5. After 60 moles of aqueous silver nitrate solution were added over 6.5 minutes an aqueous solution of mixed halides (KCl, KI, $NH_4Br$) was added directly to vessel 1 in place of the aqueous bromide solution and precipitation continued at the same rate for a further 10 minutes. The remaining silver nitrate and aqueous bromide solutions were then added in 16 minutes to form a dispersion of mixed crystal silver halide grains. These were immediately quenched, cooled, coagulated and washed, redispersed, sensitized and coated in a manner described in Example 1.

The resulting film had high sensitivity and good image quality. The grain structure, determined by electron micrographs, comprised round cubic grains having a MGV of 1.25 cubic microns and a GSD of between 0.6 and 2.1 cubic microns.

EXAMPLE 6

An aqueous gelatin solution (A) containing traces of rhodium was prepared and digested in conventional manner, and was placed in precipitation vessel 1, heated to a temperature of 120° F. (48.9° C.), and agitated.

3 molar silver nitrate (B) was prepared in a conventional manner, placed in a supply vessel 22, and heated to 120° F. (48.9° C.).

An aqueous solution (C) of a mixed halide (NaCl-NaBr) was prepared and heated to 120° F. (48.9° C.).

The digested gelatin solution (A) was fed into the recycle paths 6,7 at a flow rate of 2 gallons per minute (7.57 liters per minute) in each loop. Aqueous silver nitrate (B) and mixed halide solution (C) were simultaneously added to their respective recycle paths as in Example 1 through the side stream of tee-mixers 14, 14*a*. The dispersion of the initially precipitated grains was continuously recycled at a recycle ratio of 79. Silver nitrate and the mixed halide solution were continuously added to the recycle paths for 5 minutes at a temperature of 120° F. (48.9° C.) and the pAg in the conversion vessel maintained at 5.1. The reentry velocity of the jets was 26 ft./sec. (7.93 m/sec.). Continuous addition of silver nitrate and the mixed halide solutions to the respective recycle paths was continued for another 23 minutes at 120° F. (48.9° C.), while the pAg in the precipitation vessel was maintained at 6.7. The dispersion in the precipitation vessel was continuously recycled at a recycle ratio of 20. This dispersion of silver halide grains was immediately quenched, cooled, coagulated, and washed, redispersed, sensitized and coated in the manner described in Example 1.

The resulting film was a useful lithographic film having high sensitivity and good dot quality. Electron micrographs of the silver chlorobromide grains revealed that they were rounded cubic grains with a GSD of between 0.0016 and 0.013 cubic micron and a MGV of 0.0058 cubic micron.

Industrial Applicability

The process of the invention is useful for preparing silver halide emulsions for photographic films having controlled grain structure, size and size distribution over a wide range, for example, cubic, mixed cubic and octahedral, or octahedral grains, having median particle sizes in the range of 0.004 to 3.0 cubic microns and a size distribution $\alpha$ in the range of 0.13 to 0.45 cubic micron. Temperature and pAg may be varied over a wide range in the recycle paths, and precipitation vessel to achieve the desired grain structure, size and size distribution. For example, temperature in the path and precipitation vessel may be separately controlled within the range of 100° F.–160° F. (37.8° C.–71.1° C.), and pAg may be controlled within the range of 5–11 at precipitation, to achieve the grain structure desired.

In summary, the ranges of parameters for the double loop systems are:

1. Jet reentry velocity—8–30 ft./sec. (2.44–9.14 m/sec.).
2. Jet reentry point—0.25–0.35 times the vessel diameter from the bottom of the vessel 1.
3. Jet reentry point location—radially from the center of the vessel 1 at a distance of 0.3–0.4 times vessel diameter.
4. Jet orifice size—3–5% of distance mentioned in item 2.
5. Distance between jet tips at reentry point—0.5–1.25 inches (1.27–3.175 cm) and independent of vessel size.

The process of the invention has been found particularly useful for producing fine grain, rounded, cubic structure silver halide emulsions useful in lithographic and X-ray type films.

I claim:

1. A process for preparing a photographic emulsion having a controlled silver halide grain size, structure, and size distribution, which comprises the steps of:

(1) charging a precipation vessel with an aqueous solution of gelatin, (2) cycling a portion of said aqueous solution of gelatin through a first line, adding silver nitrate thereto to form a first stream, and returing said stream to said precipitation vessel, (3) simultaneously cycling another portion of said aqueous solution of gelatin through a second line, adding an alkali metal halide or mixed halide solution thereto to form a second stream, and returning said second stream to said precipitation vessel, (4) mixing both streams in said vessel to precipitate silver halide grains therein, (5) recycling the contents of said precipitation vessel into said first and second stream, and thence back into the precipitation vessel, whereby additional silver halide is precipitated on the initially precipitated grains to form silver halide grains of controlled structure, size and size distribution, characterized in that all of the aforesaid streams are introduced into the precipitation vessel in the form of high velocity downwardly directed jets positioned in close proximity to each other and which terminate below the liquid level in the vessel, whereby the recycled streams are uniformly mixed in a defined region and silver halide grains are precipitated at uniform pAg.

2. The process of claim 1 wherein the high velocity jets are directed vertically downwards and discharged in a conical envelope at an angle of about 20° and with a high degree of turbulent mixing.

3. The process of claim 1 wherein the high velocity jets have a velocity of about 8–30 ft./sec. (2.44–9.14 m/sec.).

4. The process of claim 1 wherein the jet reentry points are 0.25 to 0.35 times the vessel diameter from the bottom of the vessel.

5. The process of claim 1 wherein the jet reentry points are located on a line extending radially from the center of the vessel at a distance of 0.3 to 0.4 times the vessel diameter.

6. The process of claim 1 wherein the distance between jet tips at the reentry point is 0.5 to 1.25 inches (1.27–3.18 cm).

7. The process of claim 1 in which the alkali metal halide is potassium bromide.

* * * * *